United States Patent [19]

Belli et al.

[11] 3,970,453

[45] July 20, 1976

[54] IMAGING BY SELECTIVE STRIPPING OUT AREAS OF LAYER

[75] Inventors: Frank G. Belli, Webster, N.Y.; Peter P. Augostini, Graham, Tex.

[73] Assignee: Xerox Corporation, Stamford, Conn.

[22] Filed: May 28, 1974

[21] Appl. No.: 473,956

[52] U.S. Cl. ..... 96/1.4; 96/1 PS; 96/1 M; 96/28; 250/315 R; 250/318

[51] Int. Cl.[2] ..... G03G 13/22; G03G 13/14

[58] Field of Search ..... 96/1 M, 1 PS, 1.4, 28; 250/315, 318; 346/74 ES, 74 M; 360/56

[56] References Cited

UNITED STATES PATENTS

| | | | |
|---|---|---|---|
| 3,664,834 | 5/1972 | Amidon et al. | 96/28 X |
| 3,740,216 | 6/1973 | Goffe | 96/1 PS |
| 3,741,757 | 6/1973 | Goffe | 96/1 PS |
| 3,741,758 | 6/1973 | Chrzanowski et al. | 96/1 PS |
| 3,791,822 | 2/1974 | Goffe | 96/1 PS |
| 3,836,364 | 9/1974 | Lin | 96/1.4 |

*Primary Examiner*—Roland E. Martin, Jr.

[57] ABSTRACT

An imaging method comprising providing a member comprising a first layer of softenable material overlying a second layer of softenable material and both of these layers of softenable material having migration material selectively located in depth in image configuration. Additionally, the first layer of softenable material has migration material dispersed throughout the non-image portions and the second layer of softenable material is essentially free of migration material in the non-image portions. The process steps comprise applying a receiver sheet to the free surface of the first layer of softenable material and separating the receiver sheet from the imaging member thereby stripping out either portions of the first layer of softenable material or portions of the first and second layer of the softenable material simultaneously. The portions of the softenable material being stripped out contains substantially the same density of migration material. The above member may be fabricated by the process of migration imaging.

32 Claims, 17 Drawing Figures

IMAGING BY SELECTIVE STRIPPING OUT AREAS OF LAYER

BACKGROUND OF THE INVENTION

This invention relates generally to imagewise stripping out portions of a member with a receiver sheet. Depending upon the temperature of the receiver sheet or the imaging member, i.e., donor, the positive or negative image may be stripped out. The above member may be fabricated by the process of migration imaging.

A migration imaging system capable of producing high quality images of high density, continuous tone and high resolution has been developed. Such imaging systems are disclosed in copending U.S. patent application Ser. No. 837,591, filed June 30, 1969, the entire contents of which are hereby incorporated herein by reference. In a typical embodiment of this migration imaging system, an imaging member comprising a substrate, a layer of softenable material containing electrically photosensitive migration material is latently imaged, e.g., by electrically charging the member and exposing the charged member to a pattern of activating electromagnetic radiation, such as light. Following exposure, the charged imaging member supports a pattern of electrostatic charge in imagewise configuration typically conforming a negative of the selective pattern of activating radiation to which the charge member was exposed. In the charge-expose mode of the preferred process, this selective pattern of charge on the imaging member is typically an electrostatic latent image. The exposed imaging member supporting the electrostatic latent image is then developed by softening the softenable layer at which time the previously charged photosensitive particles which have not been exposed to radiation, migrate in depth in the softenable layer as it is softened toward the substrate.

Various methods for developing, i.e., softening the softenable material to allow migration of the migration material, are known. These various development modes include solvent vapor softening, heat softening, combinations thereof as well as other methods for softening the softenable material to allow migration of the migration material in depth in the softenable material. The imaging system disclosed in copending U.S. application Ser. No. 837,591, filed June 30, 1969, the entire contents of which is hereby incorporated by reference herein, generally comprises a combination of process steps which include forming a latent image on a migration imaging member and developing with vapor or heat or combinations thereof to render the latent image visible.

Once a migration imaging member has been developed, i.e., the softenable material has been softened sufficiently to allow migration of the migration material in depth in the softenable material and the migration material has, in fact, migrated, then the fabrication of the member for utilization in the instant application is complete.

There has recently been discovered a process of stripping out either the positive or negative image, i.e., softenable material and migration material, from a member which contains areas of substantially the same density of migration material by the method of placing a receiver sheet against the member with sufficient heat and pressure to adhere the receiver sheet to the member and then separating the receiver sheet from the imaging member thereby stripping out portions of the softenable material. These portions being stripped contain substantially the same density of migration material. Depending upon the temperature of the receiver sheet or the imaging member, i.e., donor, a positive or negative image may be stripped from the member.

U.S. Pat. No. 3,664,834 is a pertinent patent which discloses an imaging member comprising a supporting substrate and an overlayer on the substrate. More particularly, the member comprises a soluble, electrically insulating binder layer containing particles dispersed in the soluble binder. The member is processed to substantially completely remove the soluble binder and form an image and a background pattern of particles on the substrate. This member is then contacted with a transfer member which is then stripped away whereby the image or the background pattern of migrated particles is selectively released to the transfer member. U.S. Pat. No. 3,664,834 is concerned with selective stripping between high concentration of particles and areas of less concentration of particles. U.S. Pat. No. 3,664,834 does not teach stripping as in the instant invention between different concentrations of migration particles dispersed in a softenable material, i.e., a binder configuration migration imaging member. Furthermore, U.S. Pat. No. 3,664,834 is concerned with wash-away developed members, i.e., where the softenable material and unmigrated migration material has been removed leaving only particles on the substrate. U.S. Pat. No. 3,664,834 is concerned with stripping away haze, i.e., residual particles in the unmigrated exposed areas, from the heavily migrated particles of migration material, i.e., the unexposed areas. Therefore, clearly U.S. Pat. No. 3,664,834 is concerned with selective particle strip-out and not the instant invention of selective binder strip-out which includes both softenable material and migration material.

The instant invention is concerned only with softening modes of development and U.S. Pat. No. 3,664,834 is concerned with wash-away development. The instant invention is concerned with stripping away particles contained in the original imaging member softenable material. In the instant invention the particles are stripped away and with them softenable material which has been undisturbed by development. As mentioned in U.S. Pat. No. 3,664,834, the softenable material has been essentially all removed by wash-away development whereas in the instant invention the softenable material is undisturbed by development.

Another pertinent patent in U.S. Pat. No. 3,741,757 which discloses an imaging member comprising a layer of softenable material and migration material selectively distributed in depth in the softenable material in first image configuration and comprising in addition to the first image pattern of migration material a background of substantial amounts of migration material in the softenable material but spaced apart in depth from the first image pattern and the process step of removing the background. U.S. Pat. No. 3,741,757 is concerned with splitting the softenable material on the average in a plane substantially between the image pattern configuration of the member and the background of the member thereby resulting in a positive and negative image. The background also may be abraded away. The instant invention is concerned with stripping out selective areas of a binder configuration member where the softenable material has not been disturbed by development.

SUMMARY OF THE INVENTION

It is, therefore, an object of this invention to provide a layer with varying patterns of concentration. Then bring a receiver sheet into contact with this layer and stripping out a portion of this layer. Those portions being stripped away will have approximately the same concentration of migration material.

It is a further object of this invention to provide a method of preparing images by applying a receiver sheet to a donor sheet and then separating the receiver from the donor thereby stripping away portions of the donor sheet in image configuration. These portions being stripped away are of substantially the same softenable material/migration material density.

It is a further object of this invention to provide an unmigrated imaging member and then imaging this member by known techniques of migration imaging and thereafter, stripping away in image configuration portions of the member which contains particles in the softenable material of approximately the same concentration.

The foregoing objects and others are accomplished by providing a member comprising a first layer of softenable material overlying a second layer of softenable material and both of these layers of softenable material containing migration material selectively located in depth in image configuration in these layers. The first layer of softenable material has migration material dispersed throughout the non-image portions of the first layer and the second layer of softenable material is essentially free of migration material in the non-image portions of this layer. The process steps comprise applying a receiver sheet to the free surface of the first layer of softenable material with at least sufficient heat and pressure to adhere the receiver sheet sufficient to the member to allow selective stripping of the member. The receiver sheet is separated from the imaging member thereby stripping out portions of the first layer of softenable material. These portions of softenable material contain substantially the same density of migration material.

The above process may additionally comprise stripping out of portions of the second layer of softenable material of substantially the same density of migration material simultaneously with the corresponding portions of the first layer of softenable material which are being stripped away.

If a member is not provided, then a member may be fabricated by migration imaging and then subsequently apply a receiver sheet and then separating the receiver sheet from the imaging member. This process comprises providing an imaging member comprising a first layer of softenable material having migration material dispersed throughout this first layer and wherein the first layer of softenable material overlies a second layer of softenable material essentially free of migration material. Both of these layers of softenable material are capable of being softened sufficiently to allow migration of migration material in depth in these layers. The process steps comprise applying an imagewise migration force to the migration material and developing the imaged member by softening the softenable material at least sufficient to allow imagewise migration of the migration material at least in depth in the softenable layers. A receiver sheet is then applied to the free surface of the first layer of softenable material with at least sufficient heat and pressure to adhere the receiver sheet sufficiently to the imaging member to allow selective stripping of the imaging member. The receiver sheet is then separated from the imaging member thereby stripping out portions of the first layer of softenable material. These portions of the softenable material which are stripped away contain substantially the same density of migration material.

In the above process, corresponding portions of the second layer of softenable material of substantially the same density of migration material may be simultaneously stripped away with corresponding portions of the first layer of softenable material which is being stripped away.

BRIEF DESCRIPTION OF THE DRAWINGS

For a better understanding of the invention as well as other objects and further features thereof, reference is now made to the following detailed disclosure of this invention taken in conjunction with the accompanying drawings wherein.

DESCRIPTION OF THE PREFERRED EMBODIMENTS

Figure 1A:
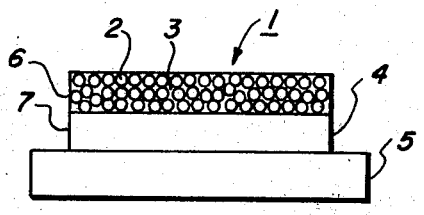
FIGS. 1 are partially schematic drawings representing forming a latent image on a binder configuration migration imaging member, developing that member, i.e., forming an imaged migration imaging member.

Referring now to FIG. 1A which shows a schematic drawing of a binder configuration migration imaging member 1 which comprises electrically insulating softenable layer 6 overlying an electrically insulating softenable layer 7. Electrically insulating softenable layer 6 comprises electrically insulating softenable material 3 which contains migration material 2 dispersed throughout layer 6. Electrically insulating softenable layer 7 is devoid of migration material and comprises electrically insulating softenable material 4. Electrically insulating softenable layer 6 overlies electrically insulating softenable layer 7 which overlies substrate 5.

Softenable layer 6 may comprise any suitable material as softenable material 3. Typically, softenable material 3 may be a plastic or thermoplastic material, which is capable of being softened sufficiently to allow migration of migration material 2 in depth in softenable material 3. Furthermore, as a specific preferred embodiment of development, the softenable material should be capable of being softened, for example, in a solvent liquid, solvent vapor, heat or combinations thereof. Preferably, softenable layer 6 should have a softening range of at least about 10°C. and an initial softening point of less than about 90°C. and a surface melt viscosity in the range between about $10^4$ to $10^9$ poise.

"Softenable" as used herein to depict softenable layers 6 and 7 is intended to mean any material which can be rendered by the development step thereof, or the softening step hereof, more permeable to particles migrating through its bulk.

Softenable material 3 of electrically insulating softenable layer 6 and softenable material 4 of electrically insulating layer 7 may be of the same material or may be of different materials. However, both of these layers, as mentioned above, should be typically a plastic or thermoplastic material, which is capable of being softened sufficiently to allow migration of migration material in depth in both of these softenable materials during the development step.

Typically preferred substantially electrically insulating softenable material useful for softenable material 3 and softenable material 4, include a host of plastic and thermoplastic material, examples of which are specifically recited in copending application Ser. No. 837,591, filed June 30, 1969, the entire contents of which is hereby incorporated by reference; paraffins and waxes and other materials which are typically substantially electrically insulating and capable of being softened sufficiently to allow migration of migration material may be used in the advantageous system of the present invention. Such substantially electrically insulating softenable material will typically have resistivities not less than about $10^{10}$ ohms-cm., and preferably have resistivities not less than about $10^{12}$ ohms-cm.

Softenable layer 6 and softenable layer 7 may be of any suitable thickness. Softenable layer thicknesses from about ½ to about 16 microns are found to be preferred.

Typical binder configuration migration imaging members may be used in the instant invention, and are disclosed in copending U.S. patent application Ser. No. 837,591, filed June 30, 1969, the entire contents of which is hereby incorporated by reference herein.

Migration material 2 preferably, should be substantially insoluble in the softenable material and otherwise not adversely reactive therewith, and in any solvent liquid or vapor which may be used in the softening step hereof. Photosensitive materials used as migration material 2 should permit the imaging member hereof to be imaged by the optimum electrical-optical mode hereof, to be further described, which is a single, direct optically sensitive method of producing high quality images which may then be stripped out according to the instant invention. Typical such photosensitive materials include inorganic or organic photoconductive insulating materials; materials which undergo conductive changes when preheated, for example, see Cassiers, *Photo. Sci. Engr.* 4. No. 4, 199 (1960) and materials which photoinject or inject when photoheated.

While photosensitive materials may be used in the preferred electrical migration force mode, employing electrostatic forces, any suitable non-photosensitive migration material, such as graphite, dyes, starch, granite, iron oxide, carbon black, iron, tungsten and mixtures thereof may be used as described in copending application Ser. No. 483,675, filed Aug. 30, 1965, the entire contents of which is hereby incorporated by reference herein.

Electrically photosensitive, as used herein, refers to any particles which when dispersed in a softenable electrically insulating binder or matrix layer as described herein, in response to electrical charging, imaging exposure to activating radiation, in contact with suitable softening media, are caused to selectively migrate at least in depth in layers 6 and 7.

While photosensitive particles (and "photoconductive" is used in its broadest sense to mean particles which show increased electrical conductivity when illuminated with electromagnetic radiation and not necessarily those which have been found to be useful in xerography in xerographic pigment-binder plate configurations) have been found a class of particles useful as electrically photosensitive particles in this invention and while the photoconductive effect is often sufficient in the present invention to provide in electrically photosensitive material, it does not appear to be a necessary effect. Apparently, the necessary effect according to the invention is the selective relocation of charge into, within or out of the material or particles, said relocation being effected by light acting on the bulk or surface of the electrically photosensitive material, said relocation occurring before or during development, by exposing said material or particles to activating radiation which may specifically include photochemical effects and others which cause said selective relocation of charge. This also includes any effect of the exposure to activating radiation which changes the charge receptivity of the marking material in its environment in any specific embodiment. An increase in the charge receptivity of the marking particles before or during development would typically be advantageous.

The support member or substrate 5 may be electrically conductive or insulating. Conductive substrates generally facilitate the charging or sensitization of the member according to the optimum electrical-optical mode of the invention and typically may be of copper, brass, nickel, zinc, chromium, stainless steel, conductive plastics and rubbers, aluminum, steel, cadium, silver, gold or paper rendered conductive by the inclusion of a suitable chemical therein or through conditioning in a humid atmosphere to insure the presence thereof of sufficient water content to render the material conductive. Suitable substrates which may be used in the instant invention are disclosed in copending U.S. patent application Ser. No. 837,591, filed June 30, 1969, the entire contents of which is hereby incorporated by reference herein.

Imaging processes using the binder structure imaging member 1 as illustrated in FIG. 1A having an insulating substrate, may be accomplished by any of the modes described herein by using an imaging member containing a conductive substrate or by additionally placing the insulating substrate of the imaging member in contact with a conductive member, typically grounded and then creating the imagewise migration force across the image member, for example, by charging with a corona device. Another technique, for example, for charging an imaging member having an insulating substrate may be to move the member between two corona charging devices thereby simultaneously charging both surfaces of the member to opposite potentials.

The migration imaging process utilizing the photosensitively inert migration imaging material 2, as illustrated in FIG. 1A, may be an imagewise migration force sufficient to cause migration of the migration particles created across the member in imagewise configuration. Where the electrostatic charge technique is used, the electrostatic image must typically be formed during charging because the photosensitively inert member will typically not respond to the uniform charge expose mode of electrostatic latent imaging. However, a process comprising uniformly charging and then imagewise charging to the opposite polarity, neutralizing the initial charge in the process, produces a suitable latent image. Other imaging methods suitable for use with this photosensitively inert imaging member are described in copending application Ser. No. 483,675, filed Aug. 30, 1965, the entire contents of which is hereby incorporated by reference herein. For example, the process involving charging through a mask stencil or by having shaped electrodes are particularly suited for use with this imaging member. Once an imagewise migration force is created across the member, the development steps may be performed on the described member.

Yet in another embodiment, the migration particles 2, as illustrated in FIG. 1A, may comprise particulate magnetic material and the imagewise migration force used in the migration imaging process is a magnetic field force acting on magnetic migration material. Suitable magnetic materials include iron, ferric oxide, mixtures of iron oxides with one or more of the oxides of cobalt, nickel, chromium, and various combinations thereof.

The thickness of both layers 6 and 7 is preferably from about 0.01 to about 2.0 microns thick. Although 5 micron layers have been found to give good results for some materials.

A preferred average particle size for particles 2, as illustrated in FIG. 1A is from about 0.01 to about 2.0 microns to yield images of optimum resolution and high density compared to migration layers having particles larger than about 2.0 microns. For optimum resultant image density, the particles should not be much above about 0.7 micron in average particle size. Layers of particle migration material preferably should have a thickness ranging from about the thickness of the smallest element of migration material in the layer to about twice the thickness in the largest element in the layer. It should be recognized that the particles may not all be packed tightly together laterally or vertically so that some of the thickness of layer 6, as illustrated in FIG. 1A, may constitute softenable material.

The binder structure illustrated as layer 6 of FIG. 1A, may be produced by any suitable method known in the art. Typical methods include cascade or dusting the photosensitive particles over the softenable layer 3 which the softenable layer is subjected to heat. These methods and others are disclosed in copending application Ser. No. 460,377, filed June 1, 1965, the entire contents of which is hereby incorporated by reference herein. A particular satisfactory method involves mechanically mixing the photosensitive particles and the softenable material diluted in a small amount of solvent and then draw-coating the resultant binder mixture over any suitable softenable layer 7 and allowing the coating to dry.

Figure 1B:
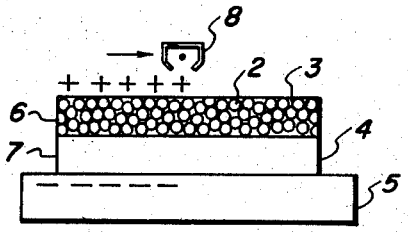
Figure 1C:
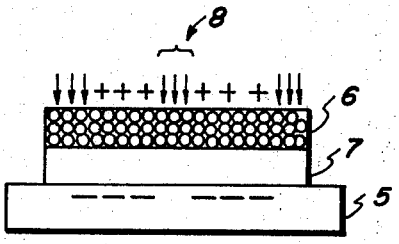

A particularly preferred embodiment of migration imaging process of the advantageous system is illustrated in FIG. 1B wherein a binder structured migration imaging member illustrated as layer 6 is overcoated on softenable layer 7 which overlies substrate 5, as illustrated as being substantially uniformly electrostatically charged. The electrostatic charging step is typically accomplished by means of a corona charging head 8 which passes across the upper surface of the binder structure layer 6 and deposits a uniform charge on its upper surface as it passes over the structure. During the electrostatic charging step, the substrate is typically grounded for preferred results. Typical corona charging methods and devices are described in Walkup, U.S. Pat. No. 2,777,957 and Carlson, U.S. Pat. No. 2,588,699. After the surface of the imaging member has been uniformly charged as illustrated in FIG. 1B, the charged imaging member is exposed to a selective pattern of activating electromagnetic radiation 8, for example, light, as illustrated in FIG. 1C.

Any suitable active electromagnetic radiation may be used. Typical types include radiation from ordinary incondescent lamps, x-rays, beams of charged particles, infrared, ultraviolet, etc. The imagewise exposure may be before, during or after charging and before or during the period when the softenable layer is in a soft condition wherein the photosensitive employed is permanent, persistent or temporary. Exposures for optimum quality images will depend on many factors including the composition of the photosensitive migration material. For example, exposure such as about ½ f.c.s. may be used for photosensitive migration material comprising phthalocyanines.

The exposure imaging member supporting the electrostatic latent image is then developed by softening the softenable layers 6 and 7 by any suitable means.

Figure 1D:
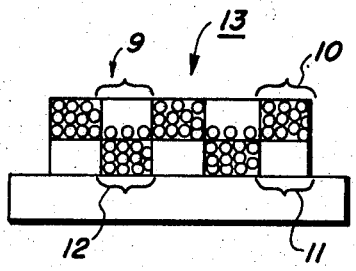

The developer may comprise solvent, solvent vapors, heat or combinations thereof, in which the softenable layers 6 and 7 are softened sufficiently to allow migration of the migration particles in depth in both layers 6 and 7 thereby forming member 13, as illustrated in FIG. 1D. Typical solvent and solvent vapors include acetone, Freon TMC, available from DuPont; trichloroethylene, chloroform, ethyl ether, xylene, dioxane, benzene, toluene, cyclohexane, 1,1,1-trichlorethane, pentane. Additional solvents and solvent vapors which may be used are disclosed in U.S. copending application Ser. No. 837,591, filed June 30, 1969, the entire contents of which is hereby incorporated by reference herein.

In addition to the charge-expose mode of providing an imagewise migration force across a binder structure imaging member comprising a softenable matrix having photosensitive marking particles dispersed therein and typically supported upon a clear softenable layer which is supported upon a substrate, are such forces as electrical or electrostatic, magnetic, gravitational and centrifugal forces. Migration forces which may be used in the instant application are described in copending U.S. patent application Ser. No. 837,591, filed June 30, 1969, the entire contents of which are hereby incorporated by reference herein. Referring now to the imaging method of the instant invention comprising providing a member comprising a first layer of softenable material overlying a second layer of softenable material. First portions of said first layer of softenable material having particles dispersed throughout. The second portions of the first layer of softenable material contain particles but at a lower particle density, i.e., concentration, as compared to the first portions of said softenable material. The second layer portions adjacent the first portions of said first layer of softenable material are essentially free of particles and the second layer portions adjacent the second portions of the first layer of softenable material contain particles. Then the process steps of applying a receiver sheet to the free surface of the first layer of softenable material with at least sufficient heat and pressure to adhere the receiver sheet sufficient to the member to allow selective stripping of the member during the stripping step. And then the process step of separating the receiver sheet from the imaging member thereby selectively stripping out portions of the softenable material containing substantially the same density of migration material.

The above process may, in addition to selectively stripping out portions of the first layer, strip out selective portion of the second layer adjacent the first layer portions simultaneously with the stripping out of the first layer portions.

The second layer portions adjacent the second portions of the first layer, mentioned above, coupled with the second portion of the first layer equal the particles of the first portion of the first layer. Furthermore, the particles in the second layer adjacent the second portions of the first layer were migrated there through the interface between the first layer and the second layer from the second portion of the first layer.

Modes of imaging binder configuration migration imaging members, as illustrated in FIGS. 1A–1D are taught in copending U.S. patent application Ser. No. 837,591, filed June 30, 1969, the entire contents of which are hereby incorporated as reference herein. These modes include (1) applying to the migration material 2 an imagewise migration force, as illustrated in FIGS. 1B–1C, which typically is associated with the latent imagewise charge on the imaging member, which causes direct or indirectly a force on the migration material towards the underlining clear layer of softenable material and the underlying substrate. There are a variety of forces which can be applied and can be made to act on softenable material and the underlying substrate. There are a variety of forces which can be applied and can be made to act on the migration material in imagewise configuration to cause migration of the migration material in depth in the softenable layers, as illustrated in FIGS. 1B–1C. Such forces include electrical or electrostatic, magnetic, gravitational and centrifugal forces. Referring now specifically to the imaging modes hereof and to FIGS. 1A–1D.

FIG. 1A shows a partial schematic of a binder configuration migration imaging member 1 comprising softenable binder layer 6 overlying softenable layer 7 which is essentially free of migration material and overlies substrate 5.

Referring now to FIG. 1B which illustrates a latent image being formed by the optimum electrical-optical mode on member 1 where layer 6 comprises photosensitive material dispersed throughout softenable material 3. The preferred method comprises the steps of uniformly charging with a corona device 8 (FIG. 1B) and imagewise exposing 8*a* (FIG. 1C). In FIG. 1B, the imaging member is uniformly electrostatically charged, illustratively by means of a corona discharge device 8 which is shown to be traversing the member from left to right depositing a uniform, illustratively positive charge on the surface of layer 6. Corona discharging devices of the general description and operating procedure as disclosed in Vyverberg U.S. Pat. No. 2,836,725 and Walkup U.S. Pat. No. 2,777,957, are excellent sources of corona discharging devices useful in discharge of member 1. Other charging techniques and other corona discharging devices are described in copending application Ser. No. 837,591, filed June 30, 1969.

Referring now to FIG. 1C, a second step in the embodiment of the optimum electrical-optical mode of forming latent image after charging, member 1 is exposed to an imagewise pattern of activating radiation 8*a*. For a detailed description of more optimum processes of forming the latent image is described in copending U.S. patent application Ser. No. 837,591.

Copending U.S. patent application Ser. No. 837,591, filed June 30, 1969, describes images suitable for use in the present invention in great detail, and all the disclosure therein and especially the disclosure relating to such imaging processes, imaging members and materials suitable for use in the migration imaging methods used therein, is hereby expressly incorporated by reference into the present specification. Member 1 having the electrical latent image thereon, as illustrated by FIG. 1C, is developed by softening the softenable material sufficient to allow migration of the migration material through the softenable layer 6 and softenable layer 7 forming imaged migration imaging member 13 as illustrated by FIG. 1D.

The application of heat, solvent vapors or combinations thereof or any other means for softening softenable material 3 of softenable layer 6 and softenable material 4 of softenable layer 7 to allow migration of migration material 2, may be used to develop the latently imaged member, whereby migration material 2 is allowed to migrate in depth in softenable layer 7 and softenable layer 7 in image configuration. FIG. 1D illustrates developed member 13 where the migration material is shown migrated in depth in layer 6 and layer 7.

Figure 2A:
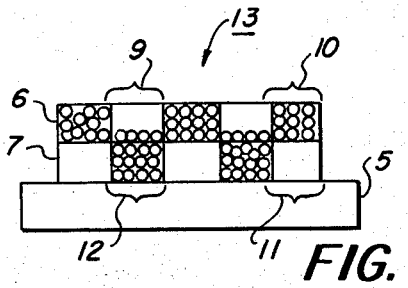
FIGS. 2 are partially schematic drawings representing heating a receiver sheet at a temperature of at least 10°C. higher than the imaging member and applying the receiver sheet to the imaging member. Then the further steps of separating the receiver sheet from the imaging member thereby stripping away either the unmigrated portion of the first layer of softenable material or stripping away the unmigrated portion of the softenable material along with portions of the second layer of softenable material corresponding to the first layer of softenable material being stripped away which contained no migration material.
Figure 3A:
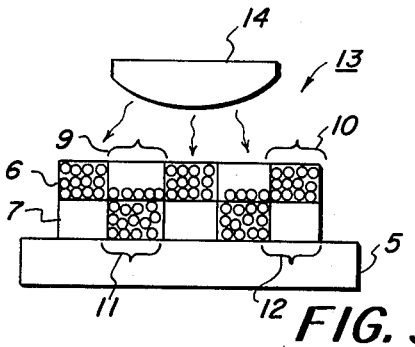
FIGS. 3 are partially schematic drawings illustrating the member being heated to a temperature of at least 10°C. higher than the receiver sheet. The receiver sheet is then placed on the member with sufficient pressure and heat to adhere the receiver sheet to the member and then the process steps of separating the receiver sheet from the member thereby stripping portions of the first layer of softenable material wherein the migration particles have migrated in image configuration, or stripping away both portions of the first layer of softenable material where migration has taken place in image configuration along with the portions of the second layer of softenable material containing migration marking material which has migrated in image configuration. The areas correspond to portions of the first layer of softenable material being stripped away.

FIG. 2A illustrates an imaged migration imaging member comprising a first layer of softenable material 6 overlying a second layer of softenable material 7. The first portions 10 of said first layer 6 have particles dispersed throughout. The second portions 9 of said first layer 6 contain migration particles but at a lower particle density than the first portion 10. The second layer portions 11 adjacent the first portions of the first layer 6 is essentially free of particles. The second layer portions 12 adjacent the second portions 9 of the first layer 6 contain particles. As illustrated by FIG. 2A and FIG. 3A, second layer portions 12 adjacent second portions 9 of first layer 6 coupled with second portions 10 of first layer 6, equal the particles of the first portions of first layer 6 (illustrated in FIG. 1A). Particles 2 in second layer 7, as illustrated in FIG. 2A and FIG. 3A, adjacent second portions 9 of first layer 6 may be migrated there through the interface between first layer 6 and second layer 7 from second portions 9 of first layer 6. Softenable layer 6 overlies softenable layer 7 which overlies substrate 5, as illustrated in FIG. 2A.

Figure 2B:
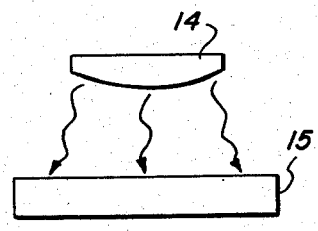

Referring now to FIG. 2B, receiver sheet 15 is illustrated as being heated by heat source 14. Receiver sheet 15 may be any suitable material such as materials described for use as substrates in copending U.S. patent application Ser. No. 837,591, filed June 30, 1969, the entire contents of which is hereby incorporated by reference herein. Such materials may be electrically conductive or insulating. Conductive substrates typically may be of copper, brass, nickel, zinc, chromium, stainless steel, conductive plastics and rubbers, aluminum, steel, cadmium, silver, gold, or paper rendered conductive by the inclusion of a suitable chemical therein or through conditioning in a humid atmosphere to ensure the presence therein of sufficient water content to render the material conductive. If desired, the conductive material may be coated on an insulator such as paper, glass, or plastic. One example comprises NESA glass, which is a substantially transparent tin oxide coated glass available from Pittsburgh Plate Glass Co. Another typical material comprises aluminized Mylar which is made up of a Mylar polyester film available from E. I. duPont de Nemours Co., Inc., having a thin, substantially transparent aluminum coating. Another typical material comprises Mylar coated with copper iodide. Other materials include conductive resin coated films such as Dow Resin 2611-7 (Dow Chemical Company) or Conductive Polymer 261 (Calgon Corporation).

Heat source 14 may be any suitable means of supplying heat. Heat source 14 may supply heat to either the receiver sheet 15 or member 13 depending upon which areas are to be stripped away. In the instant embodiment, heat source 14 supplies heat to receiver sheet 15 in order that receiver sheet 15 may be at least 10°C. higher than imaging member 13.

Heat source 14 may be any suitable means of heating receiver sheet 15 including exposure to actinic light, x-rays, beta-rays, gamma rays, electrical bombardment, corona charging, high voltage discharge, exposure to visible light, exposure to air.

Figure 2C:
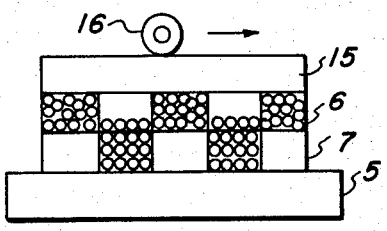

Referring now to FIG. 2C, receiver sheet 15 is pressed. under sufficient pressure against softenable layer 6 by roller 16 with at least sufficient heat and pressure to adhere receiver sheet 15 sufficient to member 13 to allow selecting stripping of member 13 when receiver sheet 15 is separated from imaging member 13.

The temperature of receiver sheet 15 should be at least 10°C. different from the temperature of imaging member 13. A positive image is obtained by maintaining the temperature of the donor, i.e., imaging member 13, at least 10°C, higher than that of the receiver, i.e., receiver sheet 15. However, a negative image is obtained by maintaining the temperature of the receiver, i.e., receiver sheet 15, at least 10°C. higher than that of the donor, i.e., member 13. A positive image is obtained in the preferred embodiment when the receiver sheet is from about 60°C. to about 100°C. preferably 80°C. and the member, i.e., donor, is maintained at a temperature from about 125°C. to about 165°C. preferably about 145°C.

The pressure applied by pressure roller 16 is preferably from about 0.5 to about 10.0 pounds per square inch and more preferably about 1 pound per square inch.

Figure 2E:
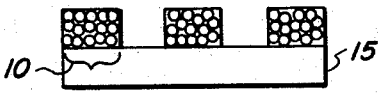
Figure 2D:
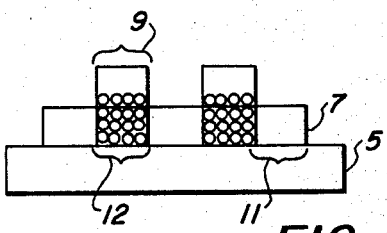

Referring now to FIG. 2D, receiver sheet 15 while maintained at a higher temperature of at least 10°C. as compared to the member, is stripped away from the member 13 leaving behind in one embodiment on the substrate, softenable layer 7 and migrated portions 9 of layer 6. The receiver sheet 15 contains non-migrated portions 10 of layer 7. Portions 10 are of substantially the same concentration of migration material 2, as illustrated in FIG. 2E.

Figure 2G:
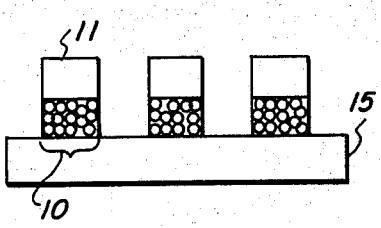
Figure 2F:
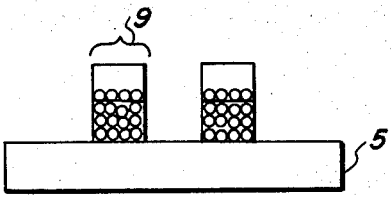

Referring now to FIG. 2F, in another embodiment of the invention, portions of both softenable layers 6 and 7 may be stripped away. Remaining on substrate 5, as illustrated in FIG. 2F, are migrated portions 9 of softenable layer 6 and the adjacent migrated portions 12 of layer 7. Portions which have been stripped away by the receiver sheet 15, as illustrated in FIG. 2G, are non-migrated portions 10 of layer 6 and portions 11 of layer 7 which contains no migration material.

Figure 3B:
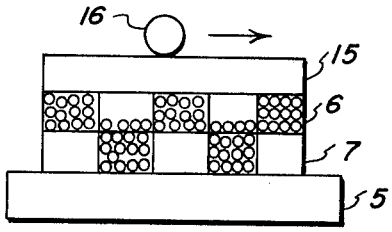

Referring now to FIG. 3A, member 13 is heated by heating element 14 to at least 10°C. different from receiver sheet 15. Receiver sheet 15 is brought into contact by sufficient heat and pressure with imaging member 13 by roller 16 by applying receiver sheet 15 to the free surface of softenable layer 6 with sufficient heat and pressure to adhere receiver sheet 15 to the member 13 to allow selective stripping of member 13. A positive image may be obtained when member 13 is heated preferably to a temperature from about 125°C. to about 165°C. more preferably to a temperature from about 145°C. and receiver sheet 15 is heated to a temperature from about 60°C. to about 100°C. and more preferably to a temperature of about 80°C. As illustrated in FIG. 3B, receiver sheet 15 is pressed against member 13 by roller 16 at a pressure preferably from about 0.5 to about 10 pounds per square inch and more preferably at 1 pound per square inch.

Figure 3D:
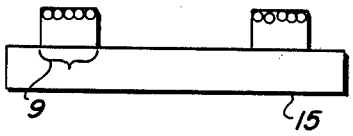
Figure 3C:
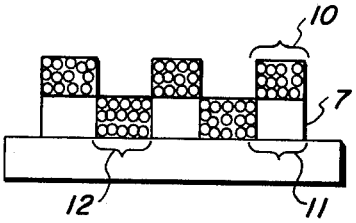

Referring now to FIG. 3C, which illustrates that the stripped member remaining on substrate 5 comprises softenable layer 7 and unmigrated portions 10 of softenable layer 6. FIG. 3D represents the receiver sheet which contains stripped softenable material portions 9 containing migration material from layer 6.

Figure 3F:
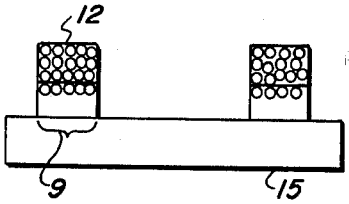
Figure 3E:
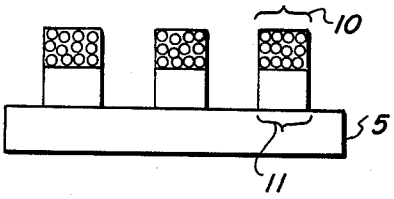

Referring now to FIG. 3E illustrating an embodiment comprising substrate 5 after the stripping step containing portions 11 of layer 7 which are devoid of migration material and adjacent portions 10 of layer 6 which contain non-migrated dispersed migration particles of layer 6. FIG. 3F illustrates receiver sheet 15 which contains the material stripped from the member, i.e., migration portions 9 of layer 6 and adjacent portions 12 of layer 7.

The following examples further specifically define the present invention of selectively stripping away a member. The parts and percentages are by weight unless otherwise indicated.

EXAMPLE I

An imaging member is prepared by depositing a double layer of softenable material on a aluminized Mylar substrate, the top layer being about a 2 micron thick layer of Nirez 1085, a polyterpene resin containing x-form metal-free phthalocyanine particles of less than about 0.5 micron in average diameter disperse throughout the layer in a pigment to binder ratio of about 1:3. The bottom layer is Piccotex 100, a copolymer of vinyl toluene and styrene available from Pennsylvania Industrial Chemical Company.

The member is latent imaged by uniformly electrostatically charging the member to a positive surface potential of about 200 volts and exposing to a negative image with exposure in exposed areas being about 0.5 f.c.s.

The latent image member is developed by exposing the member to the vapors of Freon 113 for about 20 seconds.

An imaged member results wherein a sufficient amount of the unexposed particles migrate into the Piccotex 100 to form an image while the exposed particles all remain uniformly dispersed in the Nirez 1085 layer resulting in an imaged member which appears in transmitted light as a positive. The member is then heated to 145°C. and a receiver sheet, i.e., an aluminized Mylar sheet, is heated to 80°C. The receiver sheet is pressed against the free surface of the imaging member under a pressure of about 1 pound per square inch, which is sufficient to adhere the receiver sheet sufficiently to the member to allow selective stripping of the member. The receiver sheet is then separated from the imaging member thereby stripping out a positive image on the receiver sheet.

EXAMPLE II

An imaging member is prepared by depositing a double layer of softenable material on an aluminized Mylar substrate, the top layer being about 2 microns thick of a layer of Nirex 1085, a polyterpene resin containing x-form metal-free phthalocyanine particles of less than 0.5 micron in average diameter dispersed throughout the layer in a pigment to binder weight ratio of about 1:3. The bottom layer is Piccotex 100 of about 2 microns thick.

The member is latent imaged by uniformly electrostatically charging it to a positive surface potential of about 200 volts and exposing it to a negative image with exposure in exposed areas being about 0.5 f.c.s.

The latent imaged member is developed by exposing it to vapors of Freon 113 for about 20 seconds.

An imaged member results wherein the unexposed particles migrate into the Piccotex 100 while exposed particles all remain uniformly dispersed in the Nirez 1085 layer to given an imaged member which appears in transmitted light as a positive. A receiver sheet of aluminized Mylar is heated about 145°C. The imaging member is then heated to about 80°C. The receiver sheet is then placed against the free surface of the imaging member under a pressure of about 1 pound per square inch. This is sufficient to adhere the receiver sheet sufficient to the member to allow selective stripping of the member. The receiver sheet is then separated from the imaging member thereby stripping out the negative image.

What is claimed is:

1. An imaging method comprising:

a. providing a member comprising a first layer of electrically insulating softenable material overlying a second layer of electrically insulating softenable material first portions of said first layer having migration material dispersed throughout, second portions of said first layer containing migration material at a lower density than said first portions, said second layer portions adjacent said first portions of said first layer being essentially free of migration material and second layer portions adjacent said second portions of said first layer containing migration material;

b. applying a receiver sheet to the free surface of said first layer of softenable material with at least sufficient heat and pressure to adhere the receiver sufficient to the member to allow selective stripping of the member by step (c) below; and c. separating the receiver sheet from the member thereby stripping out portions of the first layer of softenable material, said portions of said softenable material containing substantially the same density of migration material, wherein migration material particles in the second layer adjacent the second portion of the first layer were migrated there through the interface between the first layer and the second portion of the first layer.

2. The method according to claim 1 wherein the second layer portions adjacent the second portions of said first layer coupled with the second portions of said first layer equal the particles of the first portions of the first layer.

3. The method according to claim 1 wherein portions of the second layer of softenable material adjacent said portions of said first layer of softenable material are stripped away with the adjacent portions of the first layer of softenable material being stripped away by step (c).

4. The method according to claim 1 wherein the temperature of the receiver sheet in step (b) is at least 10°C. different from the temperature of the member in step (b).

5. The method according to claim 4 wherein the temperature of the receiver sheet is from about 60°C. to about 100°C.

6. The method according to claim 5 wherein the temperature of the receiver sheet is 80°C.

7. The method according to claim 4 wherein the temperature of the member is from about 125°C. to about 165°C.

8. The method according to claim 7 wherein the temperature of the member is 145°C.

9. The method according to claim 4 wherein the temperature of the member is from about 60°C to about 100°C.

10. The method according to claim 9 wherein the temperature of the member is 80°C.

11. The method according to claim 4 wherein the temperature of the receiver sheet is from about 125°C. to about 165°C.

12. The method according to claim 11 wherein the temperature of the receiver sheet is 145°C.

13. The method according to claim 1 wherein the pressure in step (b) is from about 0.5 to about 10.0 pounds per square inch.

14. The method according to claim 13 wherein the pressure is 1 pound per square inch.

15. An imaging method comprising:

a. providing an imaging member comprising a first layer of electrically insulating softenable material having migration material dispersed throughout said softenable material and wherein said first layer of said softenable material overlies a second layer of electrically insulating softenable material essentially free of migration material, both said first and second layers of softenable material being capable of being softened sufficiently to allow migration of migration material in depth in both layers of softenable material;

b. applying an electrical imagewise migration force to said migration material;

c. developing said imaging member by softening the softenable material at least sufficient to allow imagewise migration of migration material at least in depth in said softenable layers forming an imaged member comprising a first layer of softenable material overlying a second layer of softenable material, first portions of said first layer having particles dispersed throughout, second portions of said first layer containing particles but at a lower particle density, said second layer portions adjacent said first portions of said first layer being essentially free of particles and second layer portions adjacent second portions of said first layer containing particles;

d. applying a receiver sheet to the free surface of the first layer of softenable material with at least sufficient heat and pressure to adhere the receiver sheet sufficiently to the imaging member to allow selective stripping of the imaging member by step (e) below; and e. separating the receiver sheet from the imaging member thereby stripping out portions of the first layer of softenable material, said portions of said softenable material containing substantially the same density of migration material.

16. The method according to claim 15 wherein corresponding portions of the second layer of softenable material of substantially the same density of migration material are simultaneously stripped away with corresponding portions of the first layer of softenable material being stripped away by step (e).

17. The process according to claim 15 wherein the migration material is photosensitive.

18. The process according to claim 17 wherein the migration material is photoconductive.

19. The process according to claim 15 wherein the migration material is substantially photosensitively inert including photoconductive inert.

20. The process according to claim 15 wherein the migration material comprises the x-form of metal-free phthalocyanine.

21. The process according to claim 15 wherein the migration material comprises vitreous selenium.

22. The process according to claim 15 wherein the electrical latent image comprises forming an electrostatic latent image on the member.

23. The process according to claim 15 wherein formation of the electrical latent image comprises applying an external electric field to said member.

24. The method according to claim 15 wherein the temperature of the receiver sheet in step (d) is at least 10°C. different from the temperature of the member of step (c).

25. The method according to claim 24 wherein the temperature of the receiver sheet is from about 60°C. to about 100°C.

26. The method according to claim 25 wherein the temperature of the receiver sheet is 80°C.

27. The method according to claim 15 wherein the temperature of the member is from about 125°C. to about 165°C.

28. The method according to claim 27 wherein the temperature of the member is 145°C.

29. The method according to claim 15 wherein the temperature of the member is from about 60°C. to about 100°C.

30. The method according to claim 29 wherein the temperature of the member is 80°C.

31. The method according to claim 15 wherein the temperature of the receiver sheet is from about 125°C. to about 165°C.

32. The method according to claim 31 wherein the temperature of the receiver sheet is 145°C.

* * * * *